United States Patent [19]

Hall

[11] Patent Number: 4,509,924

[45] Date of Patent: Apr. 9, 1985

[54] CONTROL SYSTEM FOR TORQUE CORRECTING DEVICE

[75] Inventor: Charles B. Hall, Ingleside, Ill.

[73] Assignee: Outboard Marine Corporation, Waukegan, Ill.

[21] Appl. No.: 451,438

[22] Filed: Dec. 20, 1982

[51] Int. Cl.[3] ..... B63H 21/26

[52] U.S. Cl. ..... 440/51; 440/63

[58] Field of Search ..... 440/51, 53, 52, 62, 440/66; 114/144 R, 152, 167; 244/82

[56] References Cited

U.S. PATENT DOCUMENTS

| | | | |
|---|---|---|---|
| 2,993,464 | 7/1961 | Conover | 440/51 |
| 3,943,878 | 3/1976 | Kirkwood et al. | 440/51 |
| 4,318,701 | 3/1982 | Kirkwood et al. | 440/62 |
| 4,323,353 | 4/1982 | Kirkwood | 440/63 |
| 4,349,341 | 9/1982 | Morgan et al. | 440/62 |
| 4,352,666 | 10/1982 | McGowan | 440/51 |
| 4,362,515 | 12/1982 | Ginnow | 440/62 |

*Primary Examiner*—Trygve M. Blix

*Assistant Examiner*—Jesûs D. Sotelo

*Attorney, Agent, or Firm*—Michael, Best & Friedrich

[57] ABSTRACT

This invention provides a marine propulsion device comprising a propulsion unit, a transom bracket adapted to be fixedly connected to a boat transom and a swivel bracket mounted on the transom bracket for pivotal movement about an axis which is horizontal when the transom bracket is boat mounted. The marine propulsion device also includes a king pin assembly mounted on the swivel bracket for pivotal steering movement of the propulsion unit and a mounting mechanism for mounting the propulsion unit on the king pin assembly and permitting limited rotational movement of the propulsion unit relative to the king pin assembly. The marine propulsion device also includes a trim tab mounted on the propulsion unit for pivotal movement about an axis transverse to the horizontal axis, and a linkage mechanism for displacing the trim tab about the transverse axis in response to rotational movement of the propulsion unit relative to the king pin assembly.

12 Claims, 6 Drawing Figures

CONTROL SYSTEM FOR TORQUE CORRECTING DEVICE

BACKGROUND OF THE INVENTION

This invention relates to marine propulsion devices, and more particularly, to means for linking a movable trim tab or skeg foil to a marine propulsion device's propulsion unit so that the trim tab or skeg foil responds to torque "felt" by the propulsion unit.

Attention is directed to McGowan U.S. Pat. No. 4,352,666, issued Oct. 5, 1982, which discloses means for linking the movement of a movable trim tab to the torque on a propulsion unit. The McGowan patent is directed to means responsive to the movement of a swivel bracket relative to a transom bracket as opposed to rotation of a propulsion unit relative to a king pin assembly, as in the invention disclosed herein.

Attention is also directed to Kirkwood U.S. Pat. No. 4,323,353 and Kirkwood et al. U.S. Pat. Nos. 3,943,878 and 4,318,701 which discloses steering devices including slipping steering mechanisms which cause rotation of a trim tab.

SUMMARY OF THE INVENTION

This invention provides a marine propulsion device comprising a propulsion unit, a transom bracket adapted to be fixedly connected to a boat transom and a swivel bracket mounted on the transom bracket for pivotal movement about an axis which is horizontal when the transom bracket is boat mounted. The marine propulsion device also includes king pin means mounted on the swivel bracket for pivotal steering movement of the propulsion unit and mounting means for mounting the propulsion unit on the king pin means and for permitting limited rotational movement of the propulsion unit relative to the king pin means. The marine propulsion device also includes torque correcting means, means for mounting the torque correcting means on the propulsion unit for pivotal movement about an axis transverse to the horizontal axis, and linkage means for displacing the torque correcting means about the transverse axis in response to rotational movement of the propulsion unit relative to the king pin means.

In one embodiment, the torque correcting means comprises a trim tab and the linkage means includes a plurality of hydraulic cylinders mounted in the propulsion unit and the cylinders include double ended piston rods. Each cylinder has opposed first and second fluid chambers located on opposite sides of the piston rod and the chambers are arranged in the same sense for each of the cylinders. The first fluid chamber of the first cylinder is in communication with the second fluid chamber of the second cylinder, and the first fluid chamber of the second cylinder is in communication with the second fluid chamber of the first cylinder.

Various forces present when a marine propulsion unit is moving a boat through the water result in the propulsion unit propeller shaft becoming misaligned with the direction of boat travel. When the propeller shaft is trimmed about the horizontal axis, the displacement of the propeller can cause a turning or torque force on the propulsion unit which tends to horizontally rotate the propulsion unit. In order to compensate for the torque forces on the propulsion unit, this device includes the trim tab or skeg foil to help counteract the torque forces and make the steering of the boat easier.

When the torque forces act on the propulsion unit and cause the propulsion unit to rotate relative to the king pin means, the means for sensing this rotation adjusts the trim tab or skeg foil and thus allows for smoother steering of the boat.

Figure 2:
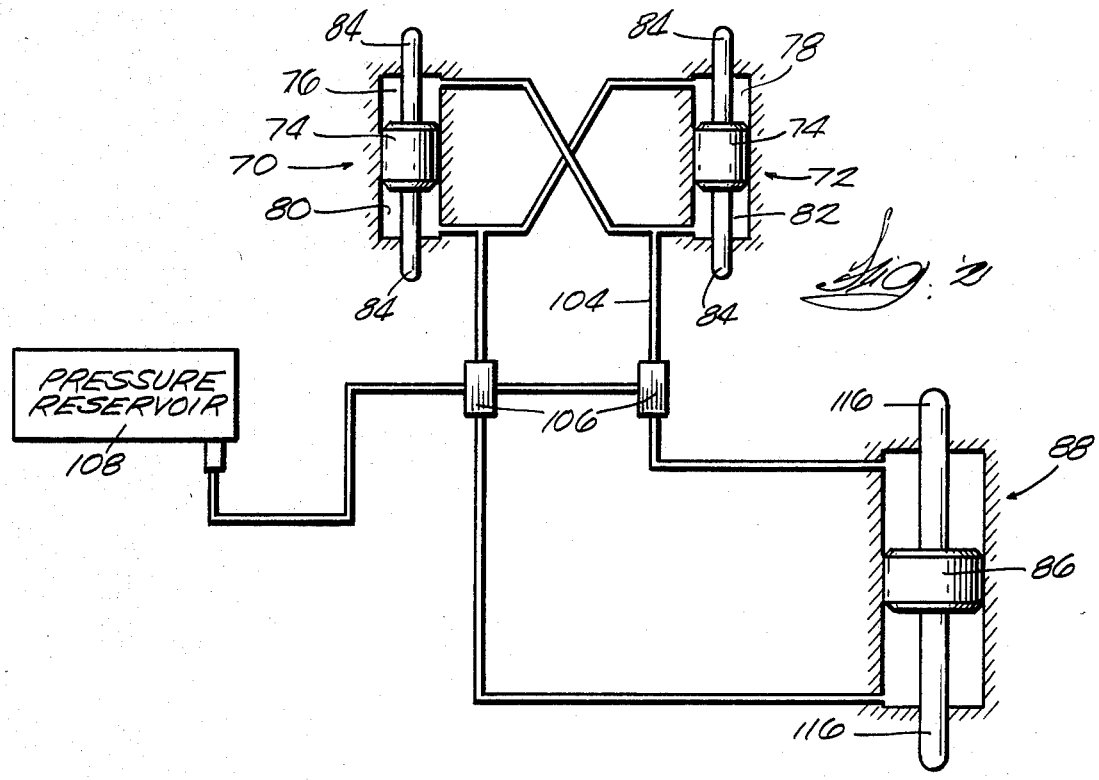
FIG. 2 is a schematic representation of means for adjusting a trim tab or a skeg foil.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

Figure 1:
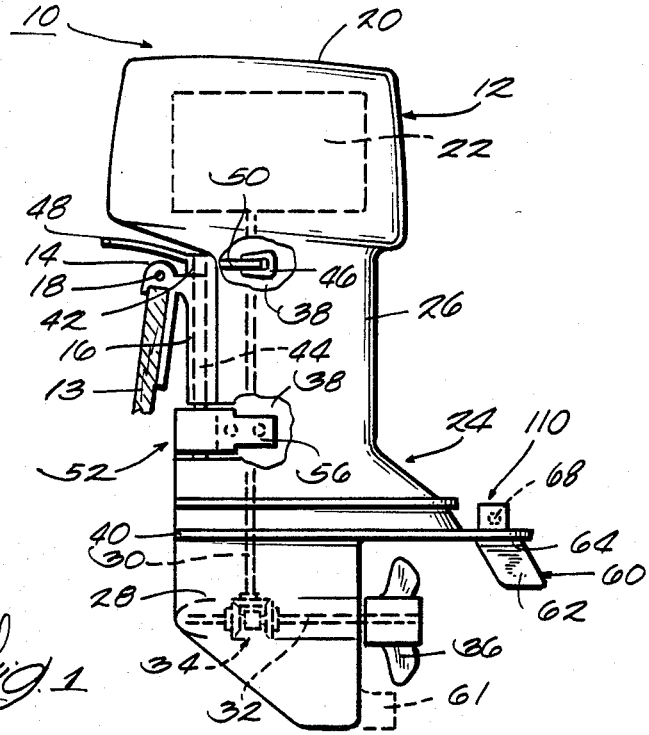
FIG. 1 is a side view of a marine propulsion device including various features of the invention.

Shown in FIG. 1 of the drawings is a marine propulsion device 10 in the form of an outboard motor including a propulsion unit 12 and means adapted to be fixedly connected to a transom 13 of a boat for mounting the propulsion unit for pivotal steering movement and for pivotal tilting movement about an axis which is horizontal when the motor is mounted. The mounting means includes a clamp or transom bracket 14 and a steering or swivel bracket 16 secured to the transom bracket 14 for vertical tilting movement by means of a pivot pin 18.

Mounted on the swivel bracket 16 is the propulsion unit 12. The propulsion unit 12 includes a power head 20 including an internal combustion engine 22 which is carried on a lower unit 24 having a drive shaft housing 26 rigidly supporting the internal combustion engine 22 and a gear case 28 rigidly attached to the bottom of the drive shaft housing 26.

Rotatably supported inside the drive shaft housing 26 is a vertically disposed drive shaft 30 which is drivingly connected to the engine 22 and also drivingly connected to a propeller shaft 32 through a reversing transmission 34 to drive a propeller 36 carried on the aft end of the propeller shaft 32. The drive shaft housing 26 includes a pair of mounting openings or recesses (generally designated at 38) located some distance above the gear case 28. The lower unit 24 also is provided with a cavitation plate 40 located approximately at the connection of the drive shaft housing 26 to the gear case 28.

The propulsion unit 12 is mounted for pivotal steering movement on the swivel bracket 16 by king pin means or assembly 42 which includes a pivot shaft 44 journaled in the swivel bracket 16. Secured to the upper end of the pivot shaft 44 is an upper resilient mount 46 having a forwardly extending steering bracket 48 and rearwardly extending arms 50. Secured to the lower end of the pivot shaft 44 is a lower resilient mount 52 comprising a yoke 54 connecting two rearwardly extending arms 56. The upper mount 46 and the lower mount 52 provide the principal support for the weight of the propulsion unit 12 and transmit the thrust force of the propeller 36 to the boat hull.

The lower mount 52 and upper mount 46 include means for isolating vibrations generated in the propulsion unit 12 from the boat hull and for permitting some limited rotational movement of the propulsion unit 12 relative to the lower mount 52. More particularly, the upper mount 46 and lower mount 52 include cushions 58 formed from a resilient material such as rubber. In this embodiment, the cushions 58 are secured between the rearwardly extending arms 56 and the drive shaft housing 26 by reason of being mounted on means for securing the drive shaft housing 26 to the lower mount 52, which in this embodiment comprises pins 59. A detailed description of one such upper and lower mount arrangement with cushions is described in the Hall U.S. Pat. No. 3,934,537, which is incorporated herein by reference.

Figure 5:
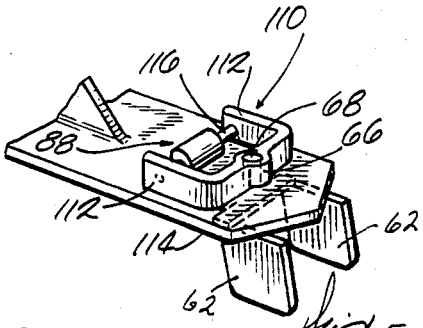
FIG. 5 is a perspective view of a portion of the propulsion device including a trim tab.

Carried by the cavitation plate 40 is torque correcting means movable between a normal running reference position and a maximum counter balancing position. In this embodiment, the torque correcting means comprises a trim tab 60, although a skeg foil 61 or other such device can be used in other embodiments. The tab 60, in the disclosed construction, includes two trim tab elements or fins 62 which can be of any suitable shape and which at their upper ends extend fixedly from a common horizontally extending member 64. If desired, the trim tab 60 can employ only a single trim tab element or fin or more than 2 elements. Extending upwardly from the horizontal member 64 and through a bearing or bushing 66 carried by the cavitation plate 40, as best shown in FIG. 5, is a stud 68 which provides for pivotal movement of the trim tab 60 about a generally vertical axis. Any suitable means can be employed to retain the stud 68 in the bearing 66 in the cavitation plate 40.

In the past, trim tabs have normally been fixed in running positions so as to overcome any steering torque present when the propulsion unit is in a lowermost position. Upward displacement of the propulsion unit 12 from the lowermost position and through the trim range results in generation of a torque condition which progressively differs from the torque occurring when the propulsion unit is in the lowermost position.

Linkage means is provided in the marine propulsion device 10 for displacing or adjusting the trim tab 60 from the usual running or reference position through a range of positions to a full correction position or a full counter balancing position as the propulsion unit 12 is trimmed upwardly or as it is lifted upward through the water so as to thereby counter or balance the progressively differing torque occurring incident to such upward movement.

As best shown in FIG. 2, the linkage means for displacing or adjusting the torque correcting means comprises a hydraulic system including sensing means 70 and 72 responsive to rotational movement of the propulsion unit 12 relative to the king pin assembly 42, means 88 for adjusting the torque correcting means or trim tab 60, and means connecting the sensing means to the adjusting means.

Figure 3:
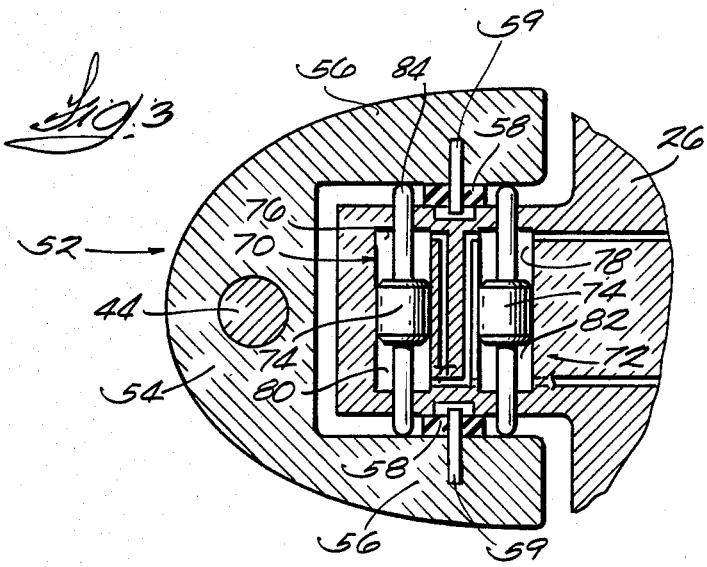
FIG. 3 is a cross sectional view of a pair of trim tab adjusting cylinders extending between the arms of the propulsion device's lower mount.
Figure 4:
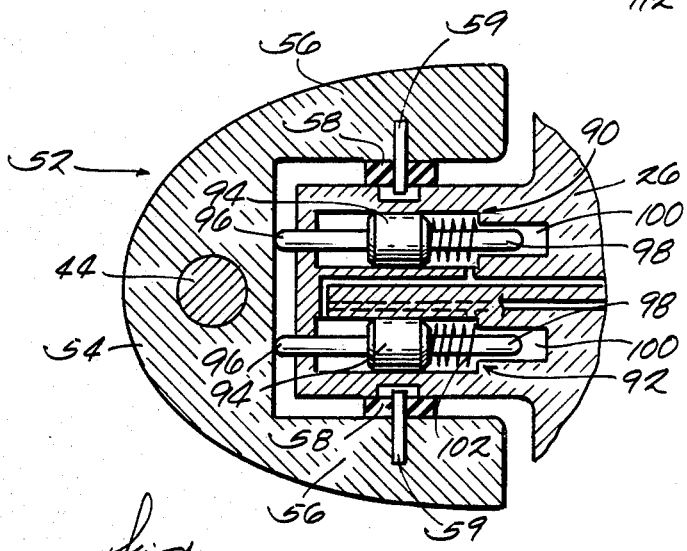
FIG. 4 is a cross sectional view of a pair of trim tab adjusting cylinders extending from a yoke of the propulsion device's lower mount.

More particularly, the sensing means responsive to rotational movement of the propulsion unit 12 relative to the king pin assembly 42 comprises a pair of hydraulic cylinders 70 and 72. In this embodiment, the hydraulic cylinders 70 and 72 are mounted in the drive shaft housing 26 between rearwardly extending arms 56 of the lower resilient mount 52, as shown in FIG. 3 or 4. In other embodiments, the cylinders 70 and 72 can be mounted between the rearwardly extending arms 50 of the upper resilient mount 46.

The cylinders 70 and 72 includes a pair of double ended piston rods 74 which move relative to the drive shaft housing 26 when the drive shaft housing 26 moves relative to the lower mount 52 in either a lateral or rotational direction. Limited movement of the drive shaft housing 26 relative to the lower mount 52 is permitted by virtue of the cushion of resilient material 58 which separates the housing 26 from the king pin assembly 42.

The cylinders 70 and 72 are connected so as to yield a net fluid displacement when the drive shaft housing 26 rotates relative to the lower mount 52, and zero net fluid displacement when the drive shaft housing 26 moves laterally relative to the lower mount 52. Thus, when torque on the propulsion unit 12 causes the drive shaft housing 26 to rotate relative to the lower mount 52, the rotational motion causes a net fluid displacement which adjusts the trim tab 60. However, lateral movement of the drive shaft housing 26, which is unrelated to the torque on the propulsion unit 12, will not result in any adjustment of the trim tab 60.

More particularly, as shown in FIG. 2, each of the pair of cylinders 70 and 72 includes a first fluid chamber on one side of the piston 74 and a second fluid chamber on the other side of the piston 74. The first fluid chamber 76 of the first cylinder 70 is in communication with the second fluid chamber 82 of the second cylinder 72, and the first fluid chamber of the second cylinder 78 is in communication with the second fluid chamber 80 of the first cylinder 70.

In one embodiment, as shown in FIG. 3, the ends 84 of the double ended piston rods 74 extend outwardly from the drive shaft housing 26 and between the rearwardly extending arms 56 on the port and starboard sides of the drive shaft housing 26.

When the ends 84 of the piston rods 74 move an equal distance when the exhaust or drive shaft housing 26 moves in a lateral direction relative to the lower mount 52, the fluid displaced in the first cylinder 70 fills the volume left by the movement of the piston in the second cylinder 72, so a zero net fluid displacement occurs.

When the drive shaft housing 26 moves in a rotational direction relative to the lower mount 52, the rod in the first cylinder 70 will move a greater distance than the rod in the second cylinder 72. This will force some fluid out of the first cylinder 70 which will not be added to the second cylinder 72. This will result in a net displacement of fluid. This net fluid displacement causes the means 88 for adjusting the trim tab 60 to be displaced an appropriate amount so as to adjust the position of the trim tab 60, as hereinafter described.

The amount of adjustment of the trim tab 60 depends on the amount of torque correction needed depending on the hydrodynamic loads on the propulsion unit 12. Since the amount of rotation of the propulsion unit 12 relative to the lower mount 52 will be proportional to the torque load on the propulsion unit 12 depending on the spring factor of the cushions 58, the area of the trim tab 60, and the area of the sensing cylinders 70 and 72, the cushions 58, trim tab 60 and cylinders 70 and 72 can be varied to achieve the necessary amount of torque correction.

When the drive shaft housing 26 rotates in an opposite direction from that just described, the net fluid displacement will cause the opposite rotation of the trim tab 60. Accordingly, after the trim tab 60 serves to counteract the hydrodynamic loads on the propulsion unit 12, the drive shaft housing 26 eventually returns to an initial unrotated position. As the drive shaft housing 26 returns to the unrotated position, the trim tab 60 returns to the running position so normal propulsion unit operation can proceed.

In another embodiment, as shown in FIG. 4, the adjusting cylinders 90 and 92 include a pair of double ended piston rods 94 with ends 96 which extend outwardly from the drive shaft housing 26 and adjacent the lower mount's yoke 54 on the fore side of the drive shaft housing 26. The other pair of ends 98 extend into a void 100 in the drive shaft housing 26 and the rods 94 are biased in the fore direction by springs 102 located in the cylinders 90 and 92. As in the embodiment previously described, lateral movement of the drive shaft housing 26 relative to the lower mount 52 will result in zero net fluid displacement, but rotational movement of the drive shaft housing relative to the lower mount 52 will result in a positive net fluid displacement which will cause the means 88 for adjusting the trim tab to be displaced to adjust or rotate the trim tab 60 depending on the direction of rotation of the drive shaft housing 26 relative to the lower mount 52.

As shown in FIGS. 2 and 5, the means provided for adjusting the torque correcting means comprises a hydraulic cylinder 88 including a double ended piston rod 86. Movement of the double ended piston rod 86 causes adjustment of the trim tab 60 by movement of a U-shaped tab bracket 110. The U-shaped tab bracket 110 includes two arms 112 connected by a yoke 114, and the tab control cylinder 88 is positioned so that the piston rod ends 116 are adjacent the bracket arms 112. The yoke 114 is connected at its midpoint to the trim tab stud 68 so that movement of the piston rod 86 pushes against one of the bracket arms 112, thus causing rotation of the bracket 110 and rotation of the trim tab 60. In another embodiment, the arms 112 could be eliminated and a pair of cylinders (not shown) connected to the trim tab adjusting cylinders 70 and 72 could move the yoke 114 to adjust the trim tab 60.

As shown in FIG. 2, the means provided for connecting the cylinders 70 and 72 to the means for adjusting the torque correcting means comprises hydraulic lines 104 together with flow check valves 106 and a pressure reservior 108. The check valves 106 and the pressure reservoir 108 are used to vary the pressure of the hydraulic system in order to compensate for fluid leakage and allow for pressurized bleeding of the hydraulic system.

Figure 6:
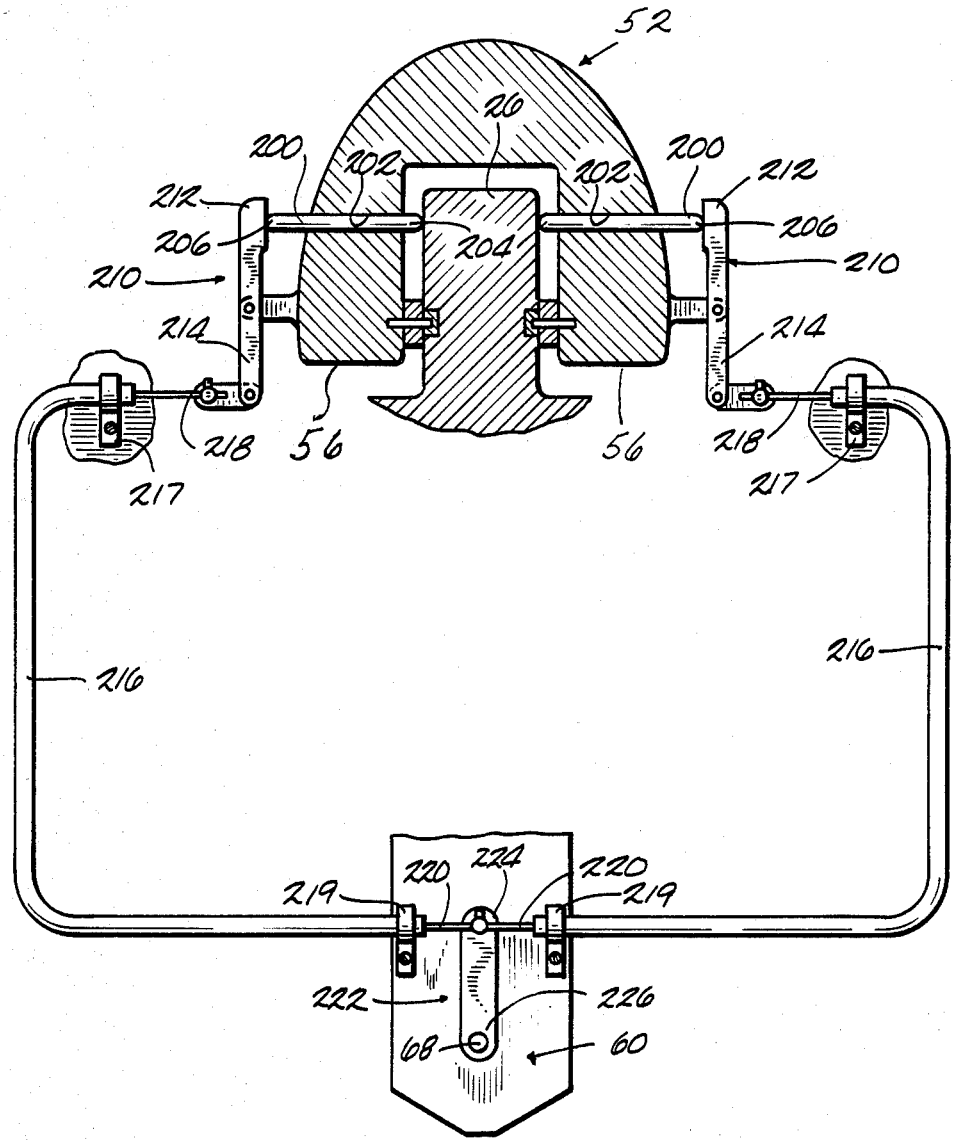
FIG. 6 is a schematic representation of another marine propulsion device including various features of the invention.

FIG. 6 provides a schematic illustration of another embodiment of the invention. In this embodiment the linkage means includes rod means 200 responsive to rotational movement of propulsion unit 12 relative to the king pin assembly 42. The rod means or rods 200 are slidably mounted in bores 202 in the rearward arms 56 of the lower mount 52 and extend perpendicularly from opposite sides of the drive shaft housing 26. A first end 204 of each rod generally abuts the opposite sides of the housing 26 and the other end 206 of each rod extends beyond the arms 56 of the lower mount 52.

In this embodiment, the linkage means also includes means connecting the rods 200 to the trim tab 60 for transmitting sliding movement of the rods 200 to pivot the trim tab 60. More particularly, this means includes levers 210 pivotally attached at their midpoint to the outside of the lower mount arms 56. One end 212 of each of the levers 210 is adjacent the ends 206 of the rods 200, and the other end 214 is attached to means for transmitting the movement of the levers 210 caused by the rods 200 to the trim tab 60. This means comprises a pair of bowden wires 216 which are fixed by clamps 217 at one end 218 near the ends 214 of the levers 200 and fixed by clamps 219 at the other end 220 near the trim tab 60. Accordingly, sliding movement of the rods 200 pivots the levers 210 and pushes and pulls respectively each of the bowden wires 216.

The ends 220 of the bowden wires 216 near the trim tab 60 are attached to means for pivoting the trim tab or arm 222. One end 224 of the arm is connected on opposite sides to ends 220 of the bowden wires 216 and the other end 226 is attached to and extends radially from the stud 68 attached to the trim tab 60, so lateral movement of the end 224 of the arm 222 pivots the trim tab 60.

Various of the features of the invention are set forth in the following claims.

I claim:

1. A marine propulsion device comprising a propulsion unit, a transom bracket adapted to be fixedly connected to a boat transom, a swivel bracket mounted on said transom bracket for pivotal movement about an axis which is horizontal when said transom bracket is boat mounted, king pin means mounted on said swivel bracket for pivotal steering movement of said propulsion unit, mounting means for mounting said propulsion unit on said king pin means and permitting limited rotational movement of said propulsion unit relative to said king pin means, torque correcting means, means for mounting said torque correcting means on said propulsion unit for pivotal movement about an axis transverse to said horizontal axis, and linkage means for displacing said torque correcting means about said transverse axis in response to rotational movement of said propulsion unit relative to said king pin means.

2. A marine propulsion device in accordance with claim 1 wherein said linkage means includes a plurality of hydraulic cylinders mounted in said propulsion unit.

3. A marine propulsion device in accordance with claim 2 wherein said torque correcting means comprises a trim tab.

4. A marine propulsion device in accordance with claim 2 wherein said torque correcting means comprises a skeg foil.

5. A marine propulsion device in accordance with claim 2 wherein rotational movement of said propulsion unit relative to said king pin means displaces said torque correcting means and lateral movement of said propulsion unit relative to said king pin means does not displace said torque correcting means.

6. A marine propulsion device in accordance with claim 2 wherein said cylinders include double ended piston rods.

7. A marine propulsion device in accordance with claim 6 wherein said plurality of cylinders consist of a first cylinder and a second cylinder each including a piston and having opposed first and second fluid chambers located on opposite sides of said pistons and said chambers are arranged in the same sense, and said first fluid chamber of said first cylinder is in communication with said second fluid chamber of said second cylinder, and said first fluid chamber of said second cylinder is in communication with said second fluid chamber of said first cylinder.

8. A marine propulsion device in accordance with claim 7 wherein said first fluid chamber of said first cylinder is in communication with a first adjusting means for adjusting said torque correcting means, and wherein said second fluid chamber of said first cylinder is in communication with a second adjusting means for adjusting said torque correcting means.

9. A marine propulsion device in accordance with claim 8 and further including a hydraulic cylinder with two opposed fluid chambers on opposite sides of a double ended piston rod, and wherein said first adjusting means comprises one fluid chamber of said hydraulic cylinder, and wherein said second adjusting means comprises the other fluid chamber of said hydraulic cylinder.

10. A marine propulsion device in accordance with claim 2 wherein said linkage means is hydraulic and wherein said linkage means further includes pressure reservoir means for maintaining the pressure of said hydraulic linkage means.

11. A marine propulsion device in accordance with claim 2 wherein said plurality of cylinders are horizontal and parallel to said horizontal axis.

12. A marine propulsion device in accordance with claim 2 wherein said plurality of cylinders are horizontal and perpendicular to said horizontal axis.

* * * * *